United States Patent [19]

Stewart

[11] 4,059,844

[45] Nov. 22, 1977

[54] SOLENOID DRIVER CIRCUIT

[75] Inventor: John W. Stewart, Wichita, Kans.

[73] Assignee: NCR Corporation, Dayton, Ohio

[21] Appl. No.: 693,035

[22] Filed: June 4, 1976

[51] Int. Cl.[2] ..... H01H 47/32

[52] U.S. Cl. ..... 361/152; 361/191

[58] Field of Search ..... 317/123, 148.5 R, DIG. 4; 361/152, 160, 153, 191

[56] References Cited

U.S. PATENT DOCUMENTS

| | | | |
|---|---|---|---|
| 3,237,088 | 2/1966 | Karp et al. | 317/DIG. 4 |
| 3,549,955 | 12/1970 | Paine et al. | 317/DIG. 4 |
| 3,579,052 | 5/1971 | Kato | 317/DIG. 4 |
| 3,786,314 | 1/1974 | Misch | 317/DIG. 4 |
| 3,896,346 | 7/1975 | Ule | 317/DIG. 4 |

*Primary Examiner*—Harry E. Moose, Jr.

*Attorney, Agent, or Firm*—J. T. Cavender; Albert L. Sessler, Jr.

[57] ABSTRACT

A driver circuit for limiting the magnitude of current flowing through a solenoid wherein the level of the current flowing through the solenoid is sensed and fed back to a driving switch. A level of current above a set level cuts off the drive voltage allowing the current in the solenoid to decay. A timing means fixes the time that the driving switch is off. During off times a conserving voltage is applied to the solenoid to prevent the rapid decay of the solenoid current.

10 Claims, 6 Drawing Figures

SOLENOID DRIVER CIRCUIT

BACKGROUND OF THE INVENTION

In the field of high-speed printing devices which are especially suitable for use in connection with electronic business systems, the wire matrix type of printer has come into increasing use. In this type of printer, letters, numbers and symbols are formed from a series of dots produced by the impact of the ends of a plurality of wire elements on record media.

Customarily, each of the individual wire printing elements of a wire matrix printer is driven by a solenoid which is energized when the printing stroke of that wire is required. To activate the solenoid quickly a high voltage, generally a square wave, is applied to the solenoid. This in turn increases the current through the solenoid at a rapid rate. As the current increases, the $I^2R$, or heating losses, also increase. The magnitude of current flowing through the solenoid for an entire print cycle is generally excessive in two ways, one; the current causes excess heating which in turn could cause destruction of the solenoid, and two; the power consumed would be greater than the power necessary to perform desired function.

A number of prior art techniques have been used in an attempt to minimize these particular problems. One such technique is disclosed in U.S. Pat. No. 3,237,088 entitled "Current Regulator For Inductive Loads", by J. R. Carp et al. The disclosed regulator circuit utilizes a resistive load placed in series with the inductor for sensing the current flowing through the inductor and for developing a voltage which is proportional to the sensed current. The voltage is fed back to a voltage comparator circuit which circuit compares the level of the developed voltage against a preselected level and provides an output indicative of the difference therebetween. The output from the voltage comparator is used to control a power amplifier which amplifier supplies the level of the voltage applied to the inductive load. The circuit disclosed in the reference patent recognizes that in order to obtain rapid changes in current through an inductor a large voltage must be available. When the current reaches the desired value, the voltage across the load inductor must be reduced to exactly the amount of IR drop in the load in order to sustain a constant load current. In addition, as previously stated, the amount of IR drop must not be allowed to cause excessive heating which in turn will cause premature failure of the inductor.

An additional prior art device of interest is disclosed in U.S. Pat. No. 3,549,955, entitled "Drive Circuit For Minimizing Power Consumption In Inductive Load", by T. O. Paine. The circuit of that patent connects the solenoid in series with a transistor switch and a resistor. The potential applied across the solenoid is controlled in its "on" and "off" state by the transistor switch. A voltage comparator monitors the voltage across the series resistor to compare the sensed voltage with a first threshold level voltage which first level is related to the pull-in current level of the solenoid. Once the solenoid has been activated the reference voltage is compared against a second threshold level, which second threshold is related to the drop-out current level of the solenoid. The transistor switch is alternately opened and closed to maintain the level of the current through the solenoid at a magnitude which is greater than the drop-out current, but substantially less than the initial pull-in current. This technique therefor minimizes the amount of power necessary to hold the solenoid in the activated position once initial pull-in is achieved.

An additional circuit of interest is disclosed in the co-pending application filed on even date herewith, U.S. Patent application Ser. No. 693,034, entitled "Solenoid Driver Circuit" by J. W. Stewart, the present inventor. The circuit of the co-pending application applies a differential voltage across the actuator solenoid and senses the current flowing through the solenoid to provide an indication of its level. When the current level reaches the desired maximum level the differential voltage is chopped off for a fixed interval of time and the current in the solenoid is allowed to decay at a controlled rate. By accurately controlling the off time of the differential voltage, increased regulation of the fluctuation of the current through the inductor is achieved.

SUMMARY OF THE INVENTION

The present invention is directed to a driver circuit for driving a solenoid at a high rate while minimizing power dissipation. The driver circuit of the present invention utilizes a switching transistor for connecting a voltage source across a solenoid. A current sensing means senses the level of current through the solenoid and switches the driver transistor to disconnect the voltage source when the sensed current exceeds a preset level. A timing means is provided for maintaining the driver transistor in an off condition for a fixed interval of time. The driver transistor is reactivated after the fixed period of time to again apply the voltage source to the solenoid. Repeated cycles continue for the duration of the solenoid activation period. During off periods a conserving potential is applied across the solenoid to control the rate of the current decay.

The circuit of the present invention therefore regulates the solenoid current in an efficient manner by turning the driver transistor on and off in response to the current level flowing through the solenoid. This function minimizes the driver power dissipation. In addition, a rapid decay of solenoid current when the driver is off during the drive interval is prevented by clamping the solenoid voltage to a conserving voltage level. An additional feature is to provide for rapid solenoid current decay when the solenoid activation period is over by clamping the solenoid voltage to a voltage, the polarity of which is in sympathy with the collapsing inductive field. In addition, means are provided for turning off the driving transistors for a fixed period of time each time the solenoid current reaches the maximum desired level. A built in safety feature requires the concurrence of three individual signals in order to activate the solenoid driver.

From the foregoing it can be seen to be a primary object of the present invention to provide an improved solenoid driver circuit.

It is another object of the present invention to provide a solenoid driver circuit which accurately regulates the current through a solenoid.

It is another object of the present invention to provide a solenoid driver circuit which regulates the decay rate of the solenoid current.

These and other objects of the present invention will become more apparent when taken in conjunction with the following description and drawings which drawings form a part of the specification and wherein like characters indicate like parts.

DESCRIPTION OF THE PREFERRED EMBODIMENT OF THE INVENTION

Figure 1:
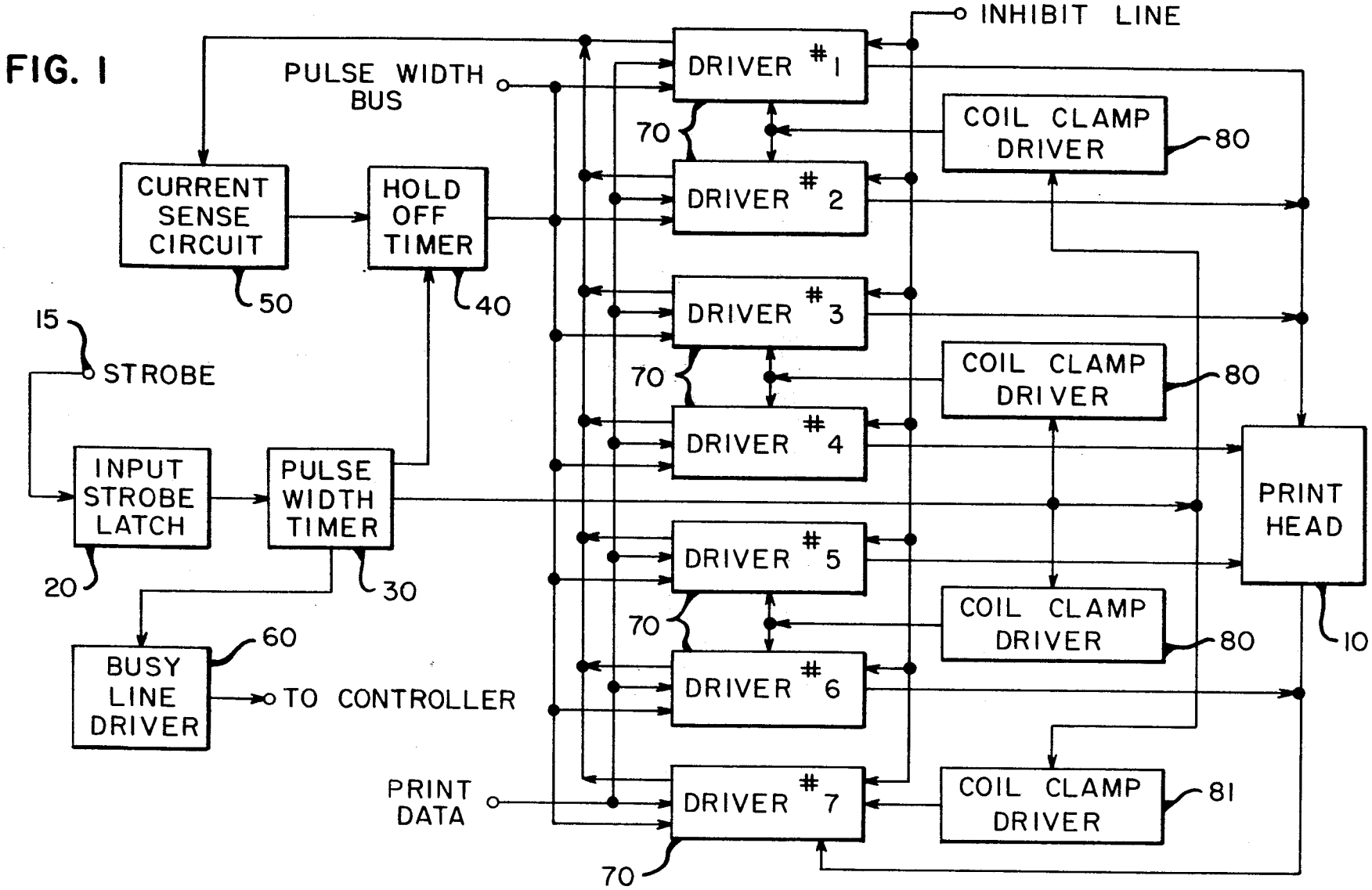
FIG. 1 is a block schematic diagram of a solenoid driver system used to drive a matrix type print head.

In FIG. 1 the print head 10 may be a matrix type print head of the type which utilizes seven individual solenoids to drive seven print wires. A print head of this type is disclosed in U.S. Pat. No. 3,882,985 entitled, "Tiltable Matrix Print Head To Permit Viewing Of The Characters", by G. N. Liles. Each solenoid of the print head 10 is driven by an individual driver circuit 70. A coil clamp driver circuit 80 is used to provide the clamping signal for two drivers. The coil clamp driver 81 is used to provide the coil clamp driver signal to a single driver circuit. An input terminal 15 receives a strobing signal which signal is directed to an input strobe latch 20. The output of this strobe latch circuit is fed to a pulse width timer 30. The pulse width timer provides a timing signal which is a function of a preselected characteristic of the strobe signal. The pulse width timer 30 directs three output signals to the busy line driver 60, the coil clamp drivers 80 and 81 and a hold-off timer 40, respectively.

Each of the driver circuits feeds a signal to the input of a current sense circuit 50. The output of the current sense circuit is directed to the hold-off timer circuit 40. The output of the hold-off timer circuit is directed to each of the driver circuits as an input along with a print data signal. In the operation of the block diagram of FIG. 1, a low level strobe signal at the input of the input strobe latch 20 will cause the output of the input strobe latch circuit to go high. With the input signal to the pulse width timer 30 high, the timer begins its count, which in the preferred embodiment is set for 700 microseconds. When the timer begins its count, its output goes high which in turn sets the busy line driver 60 output to a low level. The coil clamp drivers 80 and 81 are turned on. The signal on the pulse width bus goes high, enabling any driver having a low print data signal on its input to be energized. If the inhibit line is high (+28 volts) the drivers will turn on supplying the full 28 volts to the associated solenoids. When the current in any of the solenoids reaches the desired level, a current sense amplifier switches states and triggers the hold-off timer circuit 40. This turns off the drivers and allows the driver currents to decay. At this time, the clamp circuit becomes important. During the drive time, it is desirable to maintain solenoid current even when the drivers are turned off. This is accomplished by clamping the solenoid voltage at approximately 2 volts, which is opposite in polarity to the drive voltage direction, thus minimizing the rate of current decay. After a predetermined hold-off period has elapsed, the drivers turn back on and the solenoid currents begin to increase once more toward the desired level. When that level has been reached, the current sense amplifier once more switches states and triggers the timed hold-off circuit. This cycle is repeated until the drive time, as determined by the pulse width timer, has terminated. When the drive signal from the pulse width timer goes low each of the drivers is turned off.

Figure 2:
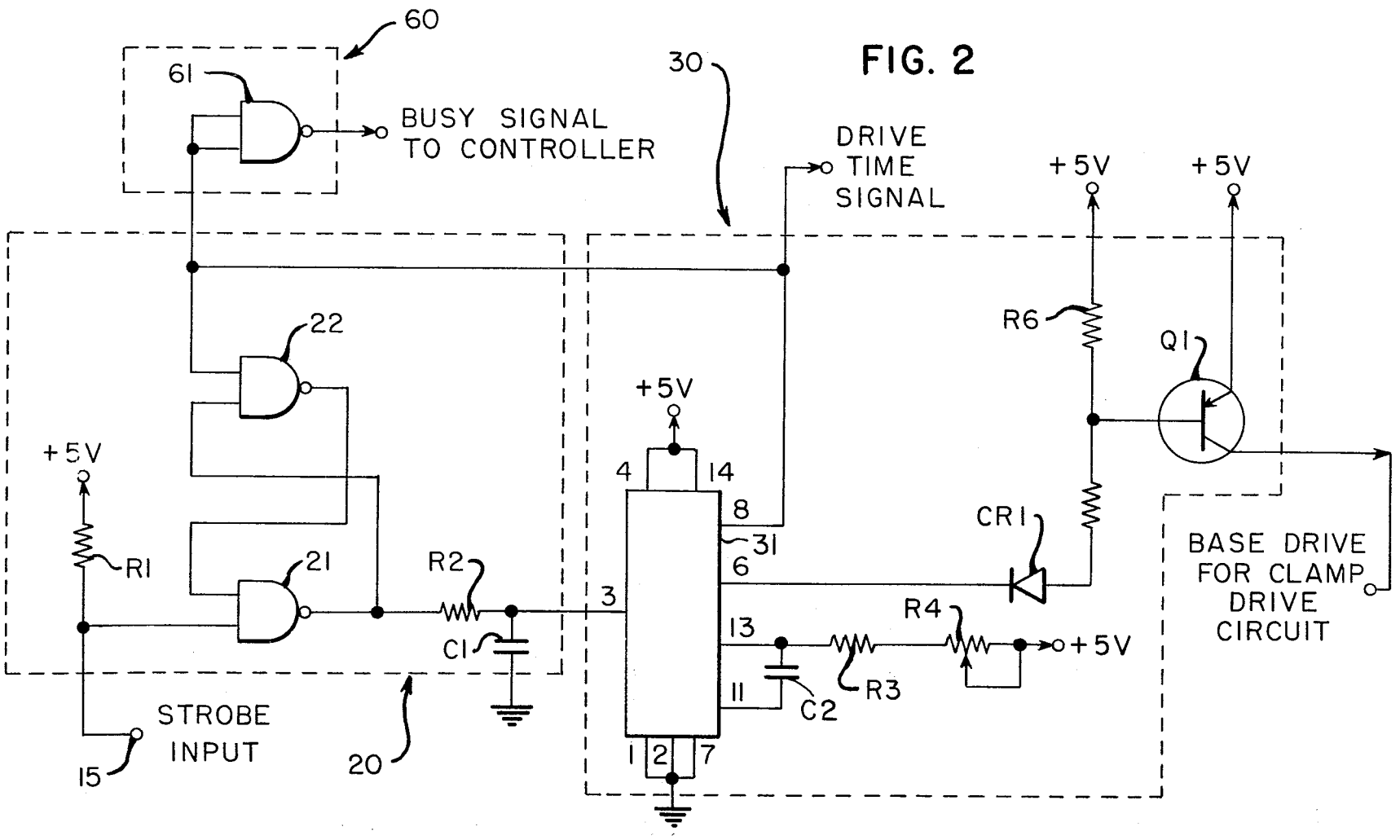
FIG. 2 is a schematic diagram of a number of the blocks shown in FIG. 1.

Referring now to FIG. 2, the input strobe latch circuit 20 contains two NAND gates 21 and 22. One input to NAND gate 21 is connected to the terminal 15 for receiving the strobe input signal and to a +5 volt supply by means of resistor R1. The remaining input to NAND gate 21 comes from the output of NAND gate 22. The output of gate 21 is connected by an RC path comprised of resistor R2 and capacitor C1 to ground with the junction of resistor R2 and capacitor C1 connected to the input labeled 3 of a timer circuit 31. The timer circuit may be a standard integrated circuit (IC) of the type manufactured by Fairchild identification No. 9601. The numbers used to identify the terminals of the timer 31 are identical to Fairchild's product specification for the IC. The output from NAND gate 21 is also connected as an input to the NAND gate 22. The output terminal 8 of the timer circuit 31 is connected to the remaining input to NAND gate 22. The signal on output terminal 8 is the DRIVE TIME SIGNAL. In operation, when a low active strobe signal appears on terminal 15 it sets the output of NAND gate 21 to a high level. The network of R2 and C1 acts as a noise filter on the input of timer 31. A positive transition on terminal 3 of timer 31 triggers the timer, beginning its 700 microsecond time period.

The busy line driver circuit 60 is shown comprised of a NAND gate 61 having its inputs connected to the output terminal labeled 8 of the timer circuit 31. The output of NAND gate 61, BUSY SIGNAL TO CONTROLLER, is directed to the controller to indicate that the printing system is either in a busy or a non-busy condition. The output of pin 8 going high causes the busy signal at the output of NAND gate 61 to the controller to go low. Terminal 6 of timer 31 also goes low to effectively turn on the base drive for transistor Q1. The base of transistor Q1 is connected to a +5 volts source by means of resistor R6 and to terminal 6 of timer 31 by means of the series combination of a resistor R5 and diode CR1. The emitter of transistor Q1 is also connected to a +5 volt source. The collector of transistor Q1 provides the base drive signal for clamping the drive circuits 80 and 81. Terminals 13 and 11 of the timing circuit 31 are connected by means of a capacitor C2, with terminal 13 being connected to a +5 volt source by means of the series connection of resistor R3 and potentiometer R4. Terminals 1, 2 and 7 of the timing network 31 are connected to ground.

Figure 3:
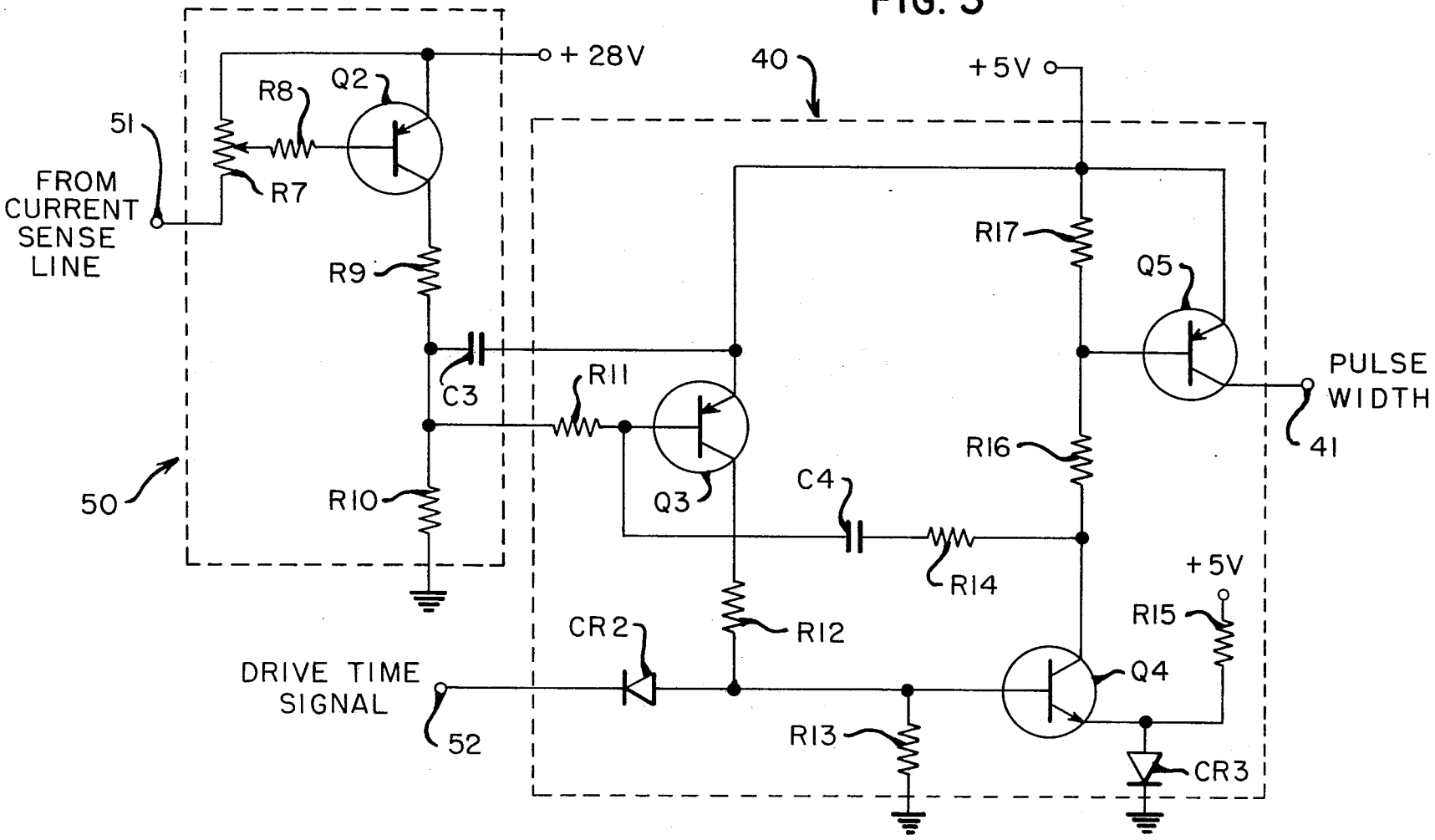
FIG. 3 is a schematic diagram illustrating the current sense network and hold-off timer blocks shown in FIG. 1.

Referring to FIG. 3, the schematic diagram for the current sensing circuit 50 and the hold-off timing circuit 40 are shown. Terminal 51 is connected to a +28 volt potential source by means of a potentiometer R7. The emitter of transistor Q2 is also connected to the +28 voltage source. The base of transistor Q2 is connected to the wiper arm of potentiometer R7 by the resistor R8. The collector of transistor Q2 is connected to ground by means of a series connection comprised of resistors R9 and R10. A capacitor C3 couples the junction of resistor R9 and R10 to a +5 voltage source. Transistor Q2 amplifies the voltage present at potentiometer R7, which voltage is a function of the sensed current through the solenoid 71. The output of the current sense circuit 50 is taken from the junction of resistors R9 and R10 and is directed to the hold-off timer 40 by means of resistor R11. Resistor R11 is connected to the base of transistor Q3. In addition the base of transistor Q3 is connected by means of a series path comprised of capacitor C4 and resistor R14 to the collector of the transistor Q4. The emitter of Q3 is connected to a +5 volt potential source. The collector of transistor Q3 is connected to the base of transistor Q4 by means of resistor R12. Terminal 52 is adapted to receive the drive timing signal from the pulse width timer 30. Diode CR2 couples terminal 52 to the base of transistor Q4. Resistor R13 connects the base of transistor Q4 to ground and in combination with resistor R12 and transistor Q3 provides the base bias for transistor Q4. The emitter of transistor Q4 is connected to ground by diode CR3 and to a +5 volt potential source by means of a resistor R15. The collector of transistor Q4 is also connected to a +5 voltage potential by means of a series connection comprised of resistors R16 and R17. The juncture of resistors R16 and R17 is connected to the base of transistor Q5. The emitter of transistor Q5 is connected to the +5 voltage potential source. The output from transistor Q5 is taken from the collector and provides the pulse width bus signal.

Figure 4:
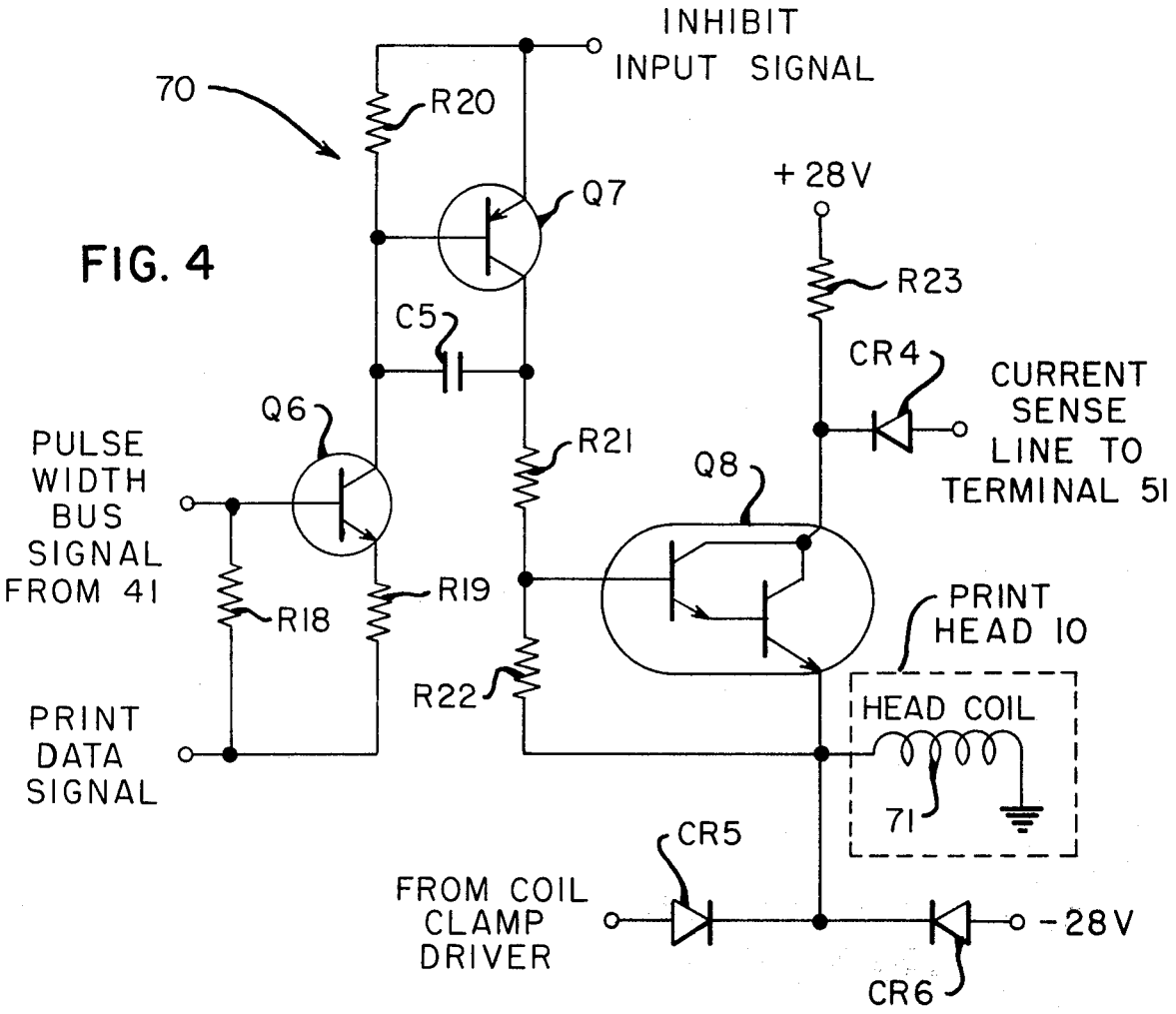
FIG. 4 is a schematic diagram illustrating a driver circuit which may be used in the system of FIG. 1.

Referring to FIG. 4, one of the seven coil drivers 70 is shown in schematic form. The pulse width bus signal from terminal 41 is applied to the base of transistor Q6. The base of transistor Q6 is connected to the print data input terminal by means of a resistor R18. The emitter of transistor Q6 is connected to the print data terminal by means of a resistor R19. The collector of transistor Q6 is connected to an inhibit input signal terminal by means of a resistor R20. The inhibit line is coupled to an inhibit circuit for inhibiting the operation of the circuit of FIG. 1 if the source of logic voltage is not within prescribed amplitude limits. Such an inhibit circuit is included in the co-pending U.S. Application Ser. No. 627,736, filed Oct. 31, 1975, inventors John W. Stewart and Ronald L. Bruckner, assigned to the assignee of the above application. The collector is also connected to the base of transistor Q7 and to the collector of transistor Q7 by means of capacitor C5. The emitter of transistor Q7 is connected also to the inhibit input signal terminal. The collector of transistor Q7 is connected to the juncture of two diodes CR5 and CR6 by means of two serially connected resistors R21 and R22. A Darlington driver pair Q8 has its base connected to the juncture of resistors R21 and R22. The collector of the Darlington pair is connected to a +28 volt potential supply by means of a low valued resistor R23. The current sense line to terminal 51 is connected to the collector of the Darlington pair Q8 by a diode CR4. The emitter of Darlington pair Q8 is connected to one terminal of a head coil (solenoid) 71 with the other terminal of the head coil being connected to ground. In the preferred embodiment the print head 10 is comprised of seven individual head coils 71. The anode of diode CR5 is connected to a terminal for receiving the clamp driver signal. The anode of diode CR6 is connected to a −28 volt potential source.

Figure 5:
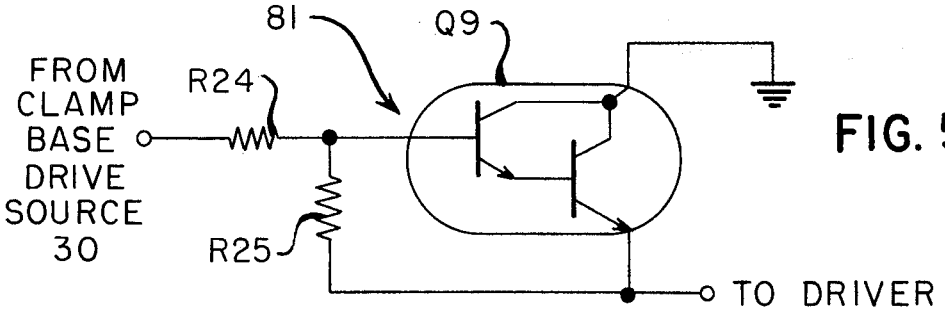
FIG. 5 is a schematic diagram illustrating a single driver type circuit which may be used in the system of FIG. 1.

Referring now to FIG. 5, a circuit which may be utilized as the individual coil clamp driver 81 is shown. The Darlington transistor pair Q9 has its base connected to receive the clamp base signal from the coil clamp driver 30 by means of resistor R24. The base of the transistor Q9 is connected to the emitter by means of resistor R25. The collector of Q9 is connected to ground. The output to the drivers is taken from the emitter of transistor Q9.

Figure 6:
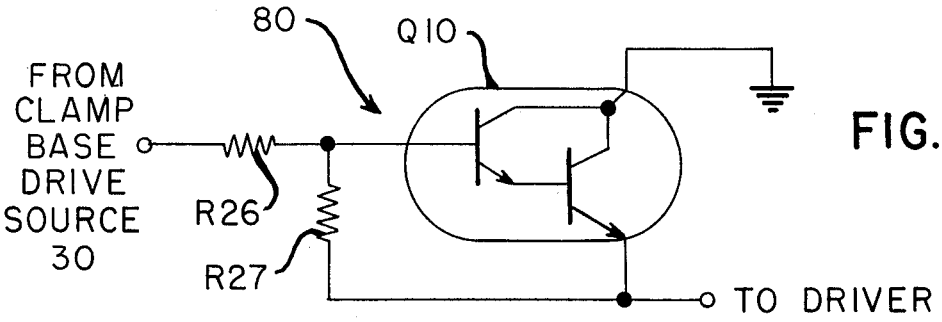
FIG. 6 is a schematic diagram illustrating a multiple driver circuit which may be used in the system of FIG. 1.

In FIG. 6 a circuit which may be used as a multiple driver circuit 80 includes a Darlington pair Q10 which has its base connected to receive the clamp base drive signal from the coil clamp driver 30 by means of resistor R26. The base of the Darlington pair Q10 is connected to the emitter of the Darlington pair by means of resistor R27. The output from the driver is taken from the emitter of transistor Q10 and directed to two drivers 70. The collector of transistor Q10 is connected to ground. While it is believed that the manner in which the device of the present invention operates will be clear from the above description to one skilled in the art, the following The following is a list of parts which may be used to form the circuits of the present invention.

| | | | | |
|---|---|---|---|---|
| | | Transistors | | |
| Q1, 7 | | | 2N5400 | |
| Q2, 3, 5 | | | 2N3906 | |
| Q4, 6 | | | 2N3904 | |
| Q8, 9 | | | 2N6295 | |
| Q10 | | | MJ3001 | |
| | | Resistors | | |
| R1, 16, 24 | | 390Ω | ¼W 5% carbon composition | |
| R2 | | 120Ω | ¼W 5% carbon composition | |
| R3 | | 4700Ω | ¼W 5% carbon composition | |
| R4 | | 50KΩ | 17 turn trimmer | |
| R5 | | 680Ω | ¼W 5% carbon composition | |
| R6, 15, 25, 27 | | 1000Ω | ¼W 5% carbon composition | |
| R7 | | 500Ω | 17 turn trimmer | |
| R8 | | 220Ω | ¼W 5% carbon composition | |
| R9, 13 | | 6800Ω | ¼W 5% carbon composition | |
| R10 | | 3300Ω | ¼W 5% carbon composition | |
| R11 | | 27KΩ | ¼W 2% metal film | |
| R12 | | 3600Ω | ¼W 5% carbon composition | |
| R14, 17 | | 470Ω | ¼W 5% carbon composition | |
| R18, 19 | | 750Ω | ¼W 5% carbon composition | |
| R20 | | 270Ω | ¼W 5% carbon composition | |
| R21 | | 100Ω | ¼W 5% carbon composition | |
| R22 | | 510Ω | ¼W 5% carbon composition | |
| R23 | | .5Ω | 1W 5% carbon composition | |
| R26 | | 330Ω | ¼W 5% carbon composition | |
| | | Capacitors | | |
| C1 | .005uf | 100V | Ceramic | ±10% |
| C2 | .068uf | 100V | Mylar | ±10% |
| C3, 4 | .0068uf | 100V | Mylar | ±10% |
| C5 | 220pf | 100V | Ceramic | ±10% |
| | | Diodes | | |
| CR1, 2, 3, 4 | IN914 | | | |
| CR5 | 1 Amp. | 100 volt | Fast Recovery Diode | |
| CR6 | 3A200 | 3 Amp. | 220 Volt | |
| | | Integrated Circuits | | |
| IC1 | | 7400 | quad. NAND | |
| IC2 | | 9601 | timer | |

While there has been shown what is considered to be the preferred embodiment of the invention, it will be manifest, that many changes and modifications may be made therein, without departing from the essential spirit of the invention. It is intended, therefore, in the annexed claims, to cover all such changes and modifications as may fall within the true scope of the invention.

What is claimed is:

1. A solenoid drive circuit comprising:

a solenoid;

switch means for operatively connecting a source of drive voltage in circuit with said solenoid; and means for cycling said switch means in response to the level of current in said solenoid to disconnect the source of drive voltage from said solenoid for fixed periods of time so as to maintain the level of current in said solenoid below a selected level.

2. The circuit according to claim 1 and further comprising:

an inhibit terminal for receiving an inhibit signal for inhibiting the cycling of said switch means if the source of logic supply voltage is not within prescribed amplitude limits.

3. The circuit according to claim 1 and further comprising:

a diode operatively connected to said solenoid;

a clamping signal source coupled to said diode for clamping said solenoid to a low potential during the periods of each cycle when said switch means is disconnecting the source of drive voltage.

4. A solenoid drive circuit comprising:

a solenoid;

a switch means having an open and a closed state for operatively connecting a source of drive voltage in circuit with said solenoid;

a current sense means for providing a sense signal the level of which is indicative of the level of current in said solenoid;

means for enabling said switch means to a closed state in response to a solenoid actuate signal; and means for cycling said switch means between said open and said closed state in response to the level of the sense signal, and for maintaining said switch means in said open state for a fixed period of time during each cycle.

5. The circuit according to claim 4 wherein said current sense means is comprised of:

a resistance of a low value, connected in series with said solenoid; and an amplifier means for amplifying the voltage developed across said resistance for providing said sense signal.

6. The circuit according to claim 4 and further comprising:

a terminal connectable to a source of voltage having a polarity opposite to the source of drive voltage;

a diode operatively connecting said terminal to said solenoid for allowing the inductive kick of said solenoid to be absorbed by the source of voltage connected to said terminal.

7. The circuit according to claim 4 and further comprising:

a diode operatively connected to said solenoid;

a clamping signal source coupled to said diode for clamping said solenoid to a low potential during the periods of each cycle when said switch means is open.

8. The circuit according to claim 4 wherein said switch means is comprised of:

a pair of emitter coupled transistors.

9. The circuit according to claim 4 and further comprising:

an inhibit terminal for receiving an inhibit signal for inhibiting the cycling of said switch means if the source of logic supply voltage is not within prescribed amplitude limits.

10. The circuit according to claim 5 wherein said current sense means is further comprised of:

means for establishing a reference voltage level signal coupled to said amplifier means to enable said amplifier means when the voltage developed across said resistance exceeds the level of said reference voltage level signal.

* * * * *

CERTIFICATE OF CORRECTION

Patent No. 4,059,844 Dated November 22, 1977

Inventor(s) John W. Stewart

It is certified that error appears in the above-identified patent and that said Letters Patent are hereby corrected as shown below:

Column 6, line 16, after "following" insert --additional description is included to aid in the ready understanding of the invention. When a strobe signal is received at the terminal 15 (Fig. 2), the output of the NAND gate 21 goes high, and said signal is applied over the noise filter network R2 comprising resistor R2 and capacitor C1 to pin 3 of the timer circuit 31, causing said timer circuit to begin its 700μsec period of "on" time. The output pin 8 of the circuit 31 goes high, the busy signal to the controller from NAND gate 61 goes low and the inverting output on pin 6 of the circuit 31 turns on the base drive transistor Q1 for the clamp drive circuits. The current in diode CR2 (Fig. 3) ceases, and the current flowing in resistor R12 is transferred to the base of transistor Q4, turning on said transistor. The transistor Q4 saturates and turns on the transistor Q5 which causes the pulse width signal on the terminal 41 to go high, thus enabling any driver 70

CERTIFICATE OF CORRECTION

Patent No. 4,059,844 Dated November 22, 1977

Inventor(s) John W. Stewart

It is certified that error appears in the above-identified patent and that said Letters Patent are hereby corrected as shown below:

(Fig. 4) which has a low print data signal. In any such driver, the transistor Q6 will turn on, supplying base current for the transistor Q7. If the inhibit input signal is high, at the voltage of +28 volts, the transistor Q7 will turn on and will supply base current to the Darlington driver pair Q8, which in turn will turn on and will supply nearly the full supply voltage of +28 volts to the print head coil 71. The coil current will increase and will eventually reach its operating maximum. The current in any coil will cause a voltage drop in the current sense resistor R23. The diode CR4 in each drive circuit acts to collect the greatest of these voltage drops and feeds it to the current level adjust potentiometer R7 (Fig. 3), which is adjusted so that the desired maximum drive current will turn on the transistor Q2 and start the turn off cycle. As the transistor Q2 saturates, the base drive for the transistor Q3 is eliminated causing transistor Q3 to turn off, and with it transistors Q4 and Q5 also turn off. The charge on the capacitor C4 holds the base of the transistor Q3 positive as the collector of the transistor Q4 swings positive during the turn off of transistor Q4. This charge on the capacitor

CERTIFICATE OF CORRECTION

Patent No. 4,059,844 Dated November 22, 1977

Inventor(s) John W. Stewart

It is certified that error appears in the above-identified patent and that said Letters Patent are hereby corrected as shown below:

C4 holds the transistor Q3 off and determines the duration of the off time period of the circuit. As the transistor Q5 turns off, the pulse width signal on the terminal 41 drops and turns off the output drivers causing the current in the sense resistors R23 to go to 0, which removes the base drive from the transistor Q2 causing it to turn off. The resistors R10 and R11 discharge the capacitor C4 and eventually supply base current to the transistor Q3 to turn it on. As the transistor Q3 turns on, base current is supplied to the transistor Q4 and it turns on. The collector voltage of the transistor Q4 decreases and causes a charging current to flow in the capacitor C4. Positive feedback is thus provided which guarantees the transistors Q3 and Q4 will latch on and will also turn on the driver once again by virtue of the transistor Q5. This on-off cycle continues until the drive time signal from the timer 31 goes low and holds-off the transistor Q4. The drive circuit is controlled by the pulse width signal on terminal 41, the print data signal, and the inhibit input signal. If all three inputs are valid, the transistors Q6, Q7 and Q8 turn on to supply voltage to the coil 71. The current in each coil is measured by the current sense resistor R23, and the voltage

CERTIFICATE OF CORRECTION

Patent No. 4,059,844 Dated November 22, 1977

Inventor(s) John W. Stewart

It is certified that error appears in the above-identified patent and that said Letters Patent are hereby corrected as shown below:

drop derived is coupled by the diode CR4 to the current sense line. When the Darlington pair Q8 is off and coil current is present, the ungrounded end of the coil will try to go negative. This transition will be limited by the diode CR6 when the drive time is over and a fast decay is necessary. During the drive time, the off state voltage will be limited by the clamp circuit and by the diode CR5. The clamping driver holds the anode of the diode CR5 at approximately -1 volt and the coil 71 is thus limited to about -2 volts. When the drive time terminates, the transistors Q1, Q9 and Q10 turn off and the diode CR6 limits the negative transition. The purpose of the capacitor C3 is to eliminate the possibility of false triggering of the hold-off circuit. A current spike is generated by the diode CR5 when the Darlington pair Q8 turns back on during the drive time, due to the stored charge in the diode CR5. This peak current can be greater than the regulated current. Thus it could turn on the transistor Q2. However this short duration peak current cannot charge the capacitor C3 enough

CERTIFICATE OF CORRECTION

Patent No. 4,059,844 Dated November 22, 1977

Inventor(s) John W. Stewart

It is certified that error appears in the above-identified patent and that said Letters Patent are hereby corrected as shown below:

to turn off the transistor Q3 and the current spike will thus not be recognized by the circuitry.--

Signed and Sealed this

*Eighth* Day of *July 1980*

[SEAL]

*Attest:*

SIDNEY A. DIAMOND

*Attesting Officer*

*Commissioner of Patents and Trademarks*